United States Patent [19]

Goldman et al.

[11] 4,276,819

[45] Jul. 7, 1981

[54] ADSORBENT ENCLOSURE FOR AUTOMATIC TISSUE PROCESSORS

[75] Inventors: Max Goldman, Latham; Arthur A. Stein, Albany, both of N.Y.

[73] Assignee: Pathology Products, Ltd., Albany, N.Y.

[21] Appl. No.: 144,910

[22] Filed: Apr. 29, 1980

[51] Int. Cl.[3] ..... F23J 11/00

[52] U.S. Cl. ..... 98/115 LH; 55/DIG. 18; 128/1 B; 135/5R; 135/34; 422/104

[58] Field of Search ..... 98/115 R, 115 LH; 422/104; 128/18; 135/5 R, 34 R; 55/DIG. 18

[56] References Cited

U.S. PATENT DOCUMENTS

| | | | |
|---|---|---|---|
| 2,624,333 | 1/1953 | Dixon et al. | 128/1 B |
| 2,967,534 | 1/1961 | Silye | 135/5 R |
| 3,492,987 | 2/1970 | Parker | 128/1 R |
| 4,202,676 | 5/1980 | Pelosi et al. | 98/115 R |

*Primary Examiner*—Ronald C. Capossela

[57] ABSTRACT

Disclosed is an apparatus which attaches to an automatic tissue processor to confine and treat the toxic fumes emanating from solvent containers used in a tissue processor. The apparatus consists of a framework clamped on the tissue processor upon which an adsorbent filter and exhauster/blower assembly are mounted and a transparent flexible cover are placed. The blower sucks the toxic fumes and intake air through the adsorbent filter where the fumes are removed from the air. The clear flexible cover has zippered panels with attached fasteners to observe tissue processor operation and provide the technologist access to the tissue processor for operation and maintenance.

3 Claims, 7 Drawing Figures

Fig. 1
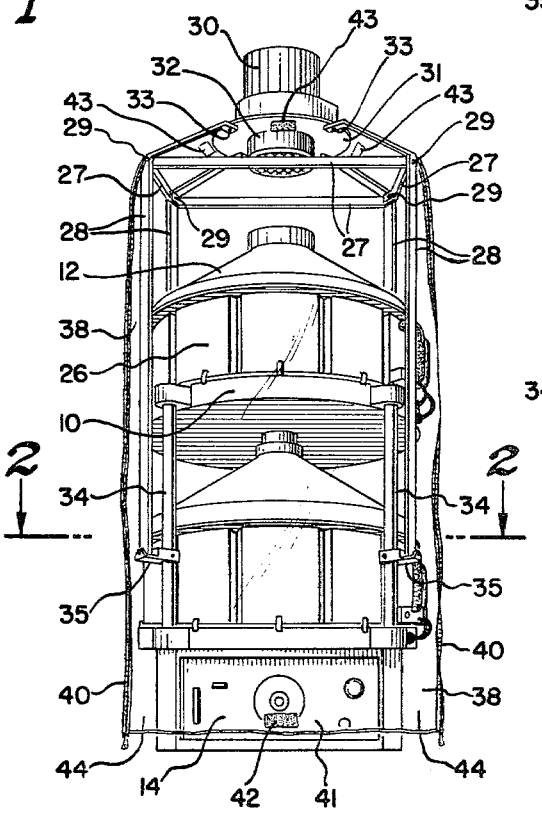
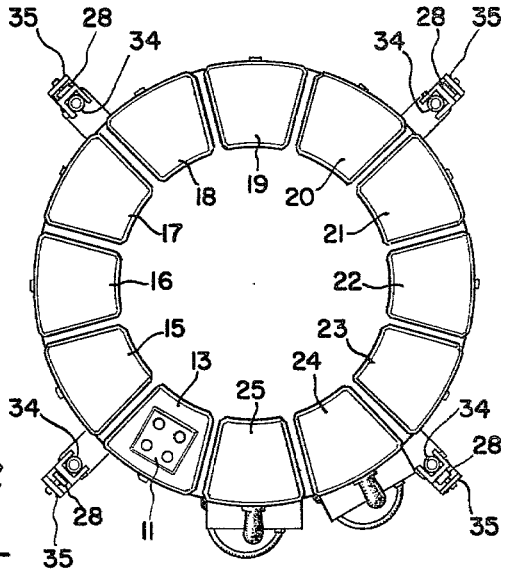
Fig. 2
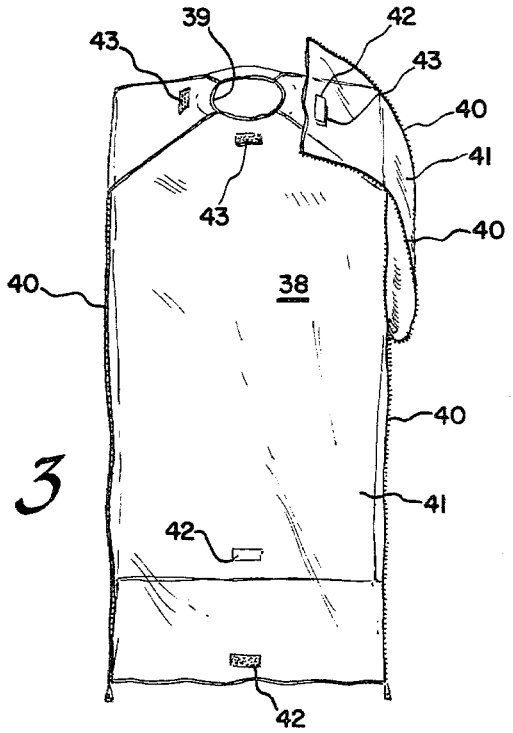
Fig. 3
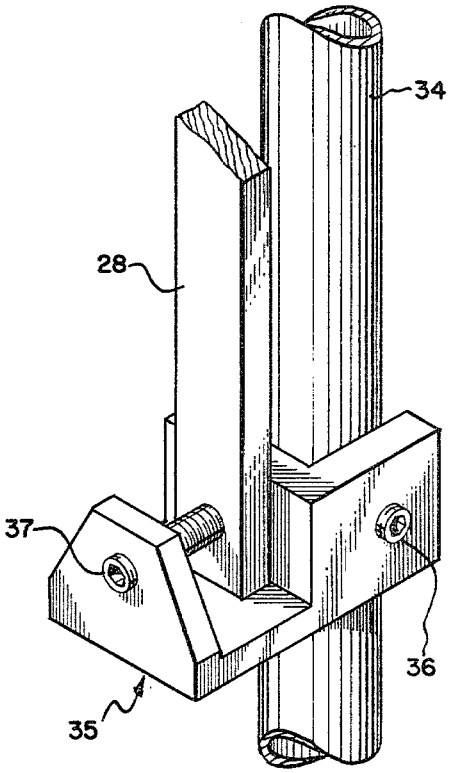
Fig. 4

ADSORBENT ENCLOSURE FOR AUTOMATIC TISSUE PROCESSORS

BACKGROUND OF THE INVENTION

This invention relates to adsorbent enclosures, and more specifically, to an adsorbent enclosure for an automatic tissue processor to filter the toxic fumes produced by the tissue processor during operation.

A pathologist's diagnosis is based upon light microscopy examination of slides of wax penetrated tissues which have been microtomed and stained. Electron microscopy examination requires similar specimen treatment with fixation, dehydration and clearing solvents, but the embedding media is a polymer rather than wax. Companies such as Technicon, Lipshaw, Tissue-Tek, American Optical, and Fisher manufacture automatic tissue processors which sequentially immerse specimens into a plurality of solvent baths. In order to be penetrated with wax, a typical sequence of solvents used on specimens in a tissue processor consists of formalin (an aqueous solution of formaldehyde), isopropyl alcohol and xylene.

Formaldehyde, xylene and isopropyl alcohol vapors which emanate from automatic tissue processors are toxic and thus controlled by OSHA (Occupational Safety and Health Act). The TLV (Threshold Limit Value), the time weighted average concentration a worker can be exposed to in an eight-hour day for formaldehyde is 3 ppm (parts per million), xylene is 100 ppm, and isopropyl alcohol is 400 ppm. Interim toxicological findings indicate that formaldehyde is a suspect carcinogen. Ventilation systems are very expensive especially in retrofitting an old laboratory and in addition cause high energy loss by the discharge of warm room air and result in governmental regulation of the points of emission.

The present invention relates to an improved adsorbent enclosure for treating the toxic vapor emanating by a tissue processor and more particularly to a framework which supports the adsorbent/exhauster blower and a clear flexible impermeable cover with provision for access during operation and maintenance. The volume exhausted from the enclosure is maintained to yield low solvent evaporation from the tissue processor's solvent baths, but with minimal risk of an explosion. The volume exhausted is balanced between high solvent evaporation at high volumetric rates and the potential for an explosion at low volumetric rates.

By way of background, the U.S. Pat. No. 2,624,333 discloses an incubator having a frame which mounts a plastic tent with zippers for access. No fasteners are used to keep the panels open during loading. No space between the tent and frame is provided for inlet air. Oxygen is supplied to the recirculated and treated air within the incubator. The incubator/framework disclosed in U.S. Pat. No. 2,624,333 does not relate to tissue processors.

By way of further background, U.S. Pat. No. 3,492,987 discloses an isolation apparatus including a tent mounted on a frame carried by a bed. A U-form slide extends around the side and bottom of one side of the enclosure to permit access to the patient. The bottom of the tent-like enclosure is sealed to the bed frame. Canisters connected by conduits to the enclosure clean contaminated air from the enclosure before passing into the room. Air is forced into the enclosure by a pump located elsewhere. The patent does not disclose a space between the bottom of the enclosure and a table or the like for permitting entry of room air, nor are flaps bordered by separate vertical zippers to permit access to the inside of the tent shown. The isolation apparatus disclosed in U.S. Pat. No. 3,492,987 does not relate to tissue processors.

SUMMARY OF INVENTION

It is an object of the present invention to provide an adsorbent enclosure for an automatic tissue processing machine which effectively treats the fumes emanated from the tissue processor when they are at a maximum concentration;

It is another object of the present invention to provide an adsorbent enclosure for an automatic tissue processor which allows ease of access to the tissue processor;

It is yet another object of the present invention to provide an adsorbent enclosure for an automatic tissue processor machine which has a volumetric flow rate such as to limit tissue processor solvent loss and yet sufficient to prevent undesireable build-up or risk of an explosion or fire within the enclosure;

It is still a further object to provide an adsorbent enclosure for an automatic tissue processing machine which is secured to the tissue processing machine by clamps.

The present invention relates to a rigid framework consisting of vertical and horizontal members secured to each other and clamped to the tissue processor. An impermeable flexible cover is secured over the framework to set up a preferred circulation system within the enclosure. Room air is sucked in the enclosure at the bottom space between the cover and the tissue processor and entrains the solvent vapors in the space between the enclosure and tissue processor. An adsorber/exhauster blower assembly located on the framework treats the air to remove the toxic fumes prior to exhaust of the treated air into the laboratory.

BRIEF SUMMARY OF THE DRAWINGS

The various aspects of the present invention will be more fully understood when the following portions of the specification are read in conjunction with the accompanying drawings wherein:

FIG. 1 is a perspective view showing the adsorbent enclosure clamped to a Duo Autotechnicon tissue processor manufactured by Technicon Corporation, Tarrytown, N.Y. This tissue processor can simultaneously process or stain at independent time cycles, two independent groups of either specimens or slides.

FIG. 2 is a sectional view of the solvent and wax containers along line 2—2 of FIG. 1.

FIG. 3 is a perspective view of the transparent flexible cover used to enclose the tissue process in FIG. 1.

FIG. 4 is a perspective view of one of the four clamps shown in FIG. 1.

DESCRIPTION OF THE INVENTION

Figure 5:
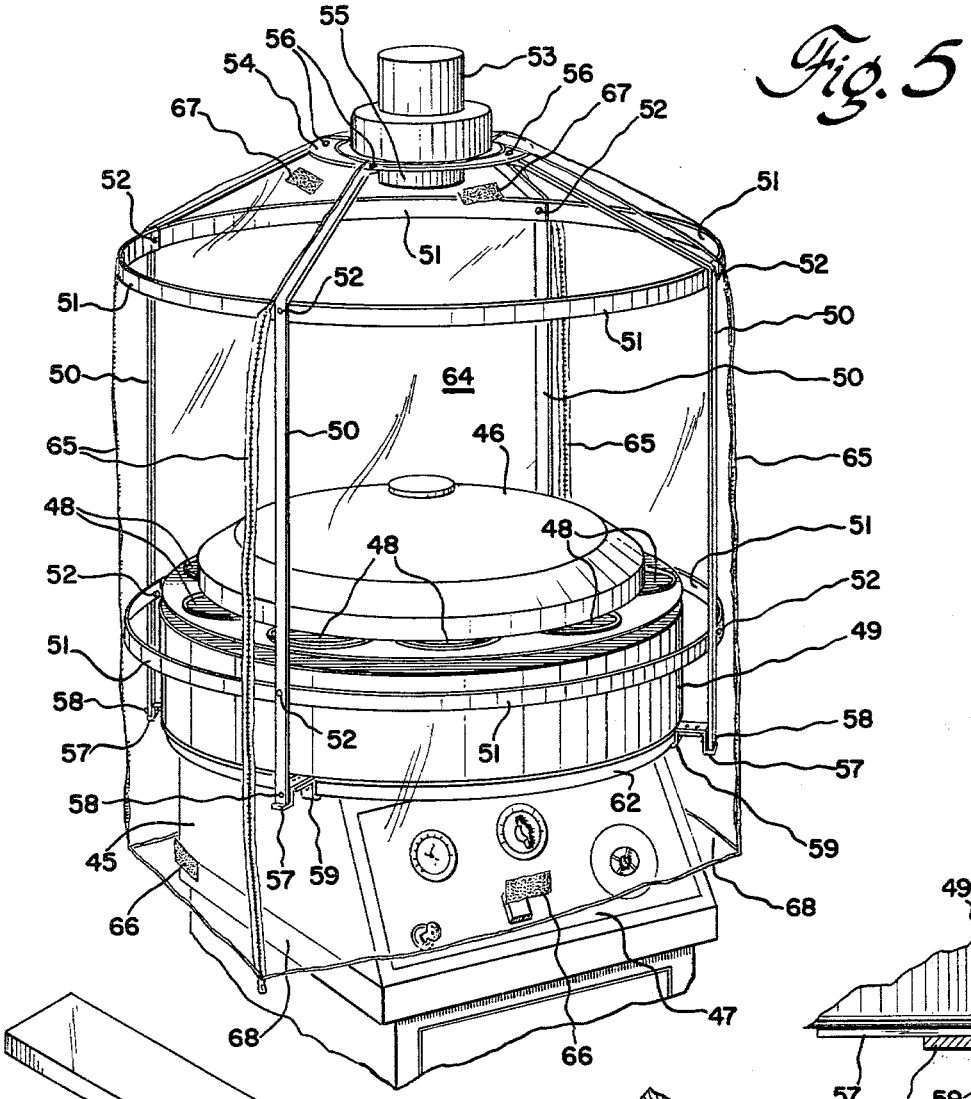
FIG. 5 is a perspective view showing the adsorbent enclosure clamped to an Ultra Autotechnicon tissue processor manufactured by Technicon Corporation.

As mentioned briefly above, the purpose of the apparatus is to enclose the tissue processor and treat the toxic fumes emanating from solvent and wax containers herein. Referring to FIG. 1, there is shown a Duo Autotechnicon Tissue Processor 10 capable of processing or staining simultaneously at different time cycles, two groups of either specimens or slides. The specimen carrier 11, in FIG. 2, which contains a number of separated and identified biopsies, is loaded into connectors located on the processor rotor 12 at the first formalin container 13 position. By setting the control panel 14, the rotor 12 and attached specimen carrier 11 are moved vertically and in a carrousel fashion into and out of the solvent and wax containers. By means of settings on the control panel 14, the dwell time of the carrier 11 in the containers 13 and 15 through 25 are fixed. The specimen carrier 11 is immersed sequentially into containers having formalin 13 and 15, isopropyl alcohol 16 through 21, xylene 22 and 23, and finally paraffin wax pots 24 and 25 maintained at 60° C. After wax impenetration of specimens in the last paraffin wax pot 25, the specimen carrier is unloaded and specimens are cast into wax blocks for microtomy. Solvent and degraded wax fumes emanate from the processor station represented by containers 13 and 15 through 25, and from the equivalent process station 26 above.

As shown in FIG. 1 the adsorbent enclosure which treats the toxic fumes emanating from the tissue processor stations includes a framework of horizontal straight members 27 joined to vertical members 28 by each of screw/nut fasteners 29. Vertical members 28 being in substantially closer proximity to one and other at its distal end. The horizontal 27 and vertical members 28 are fabricated from bendable aluminum to reduce the weight of the framework. Fumes are evacuated through a replaceable cartridge adsorbent filter 32 by a exhauster/blower 30 secured to the top of the framework by a framework mounting plate 31 which is attached by screw/nut fasteners 33 to the vertical members 28 of the framework. The framework and treatment assembly are attached to the circular support rods 34 of the tissue processor by clamps 35 shown in an enlarged perspective view shown in FIG. 4. Each of clamps 35 is located and attached to the tissue processor circular support rods 34 by set screws 36. The vertical members 28 of the framework are supported by the clamp 35 and fastened by set screws 37.

A transparent flexible cover 38, shown in FIG. 3, is mounted tightly over the framework of vertical members 28 and horizontal members 29 and has an opening 39 in the transparent cover 38 matching the housing of the exhauster/blower 30 to provide a top enclosure seal. Vertical zippers 40 are sealed or sewed into the cover 38 at position corresponding to the vertical members 28 of the framework to provide access panels 41 into the enclosure for loading and unloading the specimen carrier 11 and maintenance of the tissue processor 10. The transparent cover 28, can be opened from all four sides to provide access to the tissue processor from all quadrants. The access panel is maintained open by connection of the lower fastener element 42 to the upper fastener element 43. A Velcro sewed or sealed assembly is exemplary of the fasteners used.

Room air is sucked into the space 44, shown in FIG. 1, between the bottom edge of the transparent cover 38 and the base of the tissue processor 10. Toxic fumes are entrained by air circulation within the enclosure and pulled through the adsorbent filter 32 by exhaust/-blower 30 and treated. A 3" diameter adsorbent cartridge 32 containing 85 grams of synthetic adsorbent described in U.S. Pat. No. 4,063,912 has experimentally been found to reduce the toxic fume concentration inside the enclosure to the fume concentration measured in the exhausted air for the following histological solvents used in a typical tissue processor:

Formaldehyde—reduced from 6.2 ppm in the enclosure to 0.9 ppm in the exhaust

Xylene—reduced from 29.0 ppm in the enclosure to 1.6 ppm in the exhaust

Isopropyl alcohol reduced from 100.0 ppm in the enclosure to 0.5 ppm in the exhaust The analytical results are based on OSHA accepted colorimetric and gas chromatographic test methods for these toxic chemicals. It would be within the skill of the art to use other known adsorbents such as activated charcoal and molecular sieves.

A transition section of low pressure drop from the enclosure perimeter to the inlet area of the exhauster blower 30 is formed by bending the upper portions of vertical members 28 of the framework inwardly as shown in FIG. 1. Because of the close proximity of the enclosure to the tissue processor due to accurate clamping, a high air velocity results with low air volumetric flow rates. These design features result in good toxic fume treatment with minimal solvent evaporation from the tissue processor containers.

FIG. 5 is a perspective view of an adsorbent/enclosure clamped to an Ultra Autotechnicon tissue processor 45, also manufactured by Technicon Corporation. Since the Ultra Tissue Processor 45 operates at temperatures elevated above room temperatures, tissue fixation occurs more rapidly, but solvent evaporation is also increased. Similar to procedures previously described for the tissue processor shown in FIG. 1, the specimen carrier for the Ultra is connected to the tissue processor rotor 46. The control panel 47 determines the vertical and circular motion of the specimen carrier connected to the rotor 46. Specimens are programmed sequentially through fixation, dehydrating and clearing solvents in containers 48 circumferentially located in a temperature controlled tissue processor housing 49 of the tissue processor.

Figure 6:
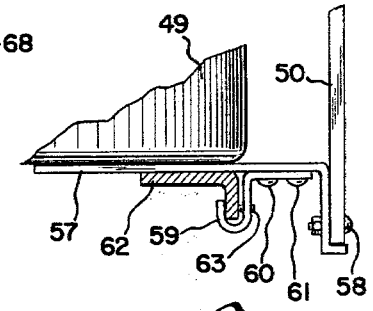
FIG. 6 is a cross sectional view showing the attachment of the clamp to the tissue processor shown in FIG. 5 and the adsorbent enclosure framework.
Figure 7:
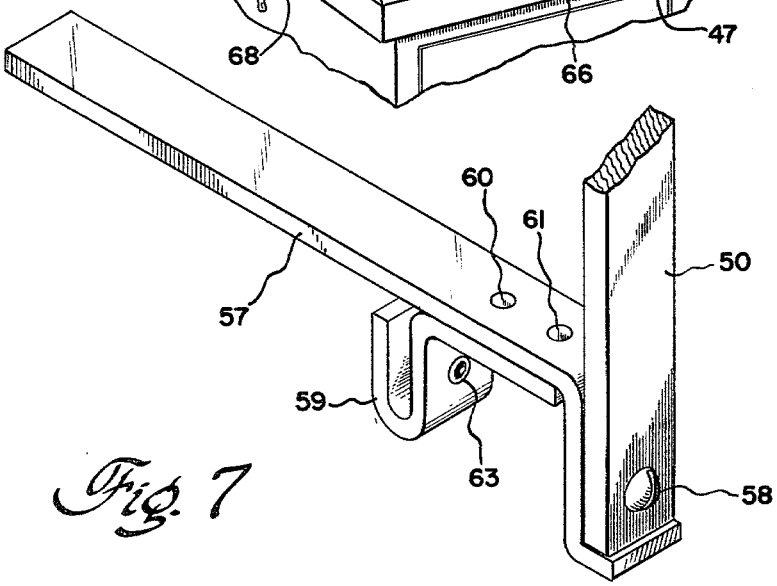
FIG. 7 is a perspective view of the clamp used to connect the tissue processor shown in FIG. 5 to the framework of the enclosure.

An adsorbent enclosure for treating the toxic fumes produced by the tissue processor comprises a plurality vertical members 50 which are attached to horizontal segmented circular members 51 of bendable aluminum by screw/nut fasteners 52. An exhauster/blower 53, mounting plate 54, and adsorbent cartridge 55 assembly is attached to vertical members by screw/nut fasteners 56. The framework formed by members 50 and 51, plus attached adsorbent/exhauster blower assembly are then connected to clamp component 57 by screw/nut fastener 58. Clamp component 57 is attached to the tissue processor housing by the following procedure:

Referring to FIG. 6 and FIG. 7, by removing set screw 61 and loosening set screw 60, clamp components 57 and 59 are positioned on a mounting rim 62 underneath the tissue processor housing 49. Set screws 61 and 62 are returned and locked in the desired position on the rim 62. Set screw 62 is tightened to lock the clamp assembly consisting of 57, and 59 to the rim 62. The framework with attached exhauster/blower and adsorbent is placed on mounted clamp component 57 and fastened with screw/nut fasteners 58.

Enclosing the frame formed by members 50 and 51 is a transparent vinyl enclosure 64 having an opening at its base and another opening at its top through which the exhauster/blower housing 53 communicates with the atmosphere. The transparent cover 64, has four vertical zippers 65 sewed in at locations corresponding to the vertical members 50 of the framework to provide access panels at all quadrants for operation and maintenance of the tissue processor 45. The access panels are maintained open by connecting the lower reclosable fastener 66 with the upper reclosable fastener 67 as previously discussed in relation to FIG. 3.

Air, sucked in at the bottom of FIG. 5 through the space 68 between the enclosure cover and the tissue processor housing entrains toxic vapors in the enclosure which in turn are adsorbed in filter cartridge 55 prior to the exhaust of the treated air into the laboratory. As previously discussed in relation to FIG. 1, the transition section due to the shape of the inwardly bent vertical members 50 at the top of the framework, and the small space between enclosure and tissue processor provide good circulation without excessive solvent evaporation from the tissue processor containers 48.

It can thus be seen that the improved apparatus of the present invention is manifestly capable of achieving the above enumerated objects, and while preferred embodiments have been disclosed, it will be appreciated that the present invention is not limited, thereto, but may be otherwise embodied within the scope of the following claims.

What is claimed is:

1. An apparatus for use with a tissue processing machine comprising of:

a rigid frame means formed of a plurality of substantially vertically extending spaced apart members and a plurality of horizontal members, each vertical member secured to each adjacent vertical member by at least one horizontal member;

means for securing the tissue machine to said frame means so that the tissue processing means extends substantially into the volume defined by said frame means;

a transparent impermeable tent means secured to and surrounding said frame means, said tent means having a first opening through which the tissue machine extends into said frame means and having a second opposed opening parallel to said first opening said tent means having a plurality of entrance panels through which access may be gained to the tissue machine; and fume removal means attached to said frame means and communicating through said second tent means opening, said fume removal means evacuating the toxic fumes within said tent means, filtering said toxic fumes and releasing the filtered fumes to the atmosphere.

2. Apparatus described in claim 1 wherein an air flow transition section is formed by bending the vertical members adjucent said fume means, said transition section produces low pressure drop air circulation and reduced build-up of stagnant zones of flammable or explosive fumes in the enclosure.

3. Apparatus described in claim 1 wherein said means for securing are locking devices so designed to avoid drilling holes in the tissue processor housing and possibly damaging electrical controls or heating fluid systems in the tissue processor housing.

* * * * *